United States Patent [19]

Olson

[11] 4,152,002

[45] May 1, 1979

[54] SKI BOOT CARRIER

[76] Inventor: David V. Olson, 324 IDS Tower, Minneapolis, Minn. 55402

[21] Appl. No.: 860,986

[22] Filed: Dec. 15, 1977

[51] Int. Cl.[2] ..... A63C 3/00

[52] U.S. Cl. ..... 280/11.37 R; 224/45 S

[58] Field of Search ..... 224/45 S, 46 R, 45 Q, 224/55; 280/11.37 R, 11.37 A, 11.37 K, 11.37 E, 19, 18, 28; 190/41 R, 60, 18 R; 24/3 R, 68 SK, 73 SG

[56] References Cited

U.S. PATENT DOCUMENTS

| | | | |
|---|---|---|---|
| 3,399,750 | 9/1968 | Woolworth | 224/45 S |
| 3,666,282 | 5/1972 | Buening et al. | 280/18 |

FOREIGN PATENT DOCUMENTS

| | | | |
|---|---|---|---|
| 140269 | 2/1934 | Fed. Rep. of Germany | 280/11.37 A |
| 1299186 | 6/1962 | France | 280/11.37 R |
| 2310781 | 10/1976 | France | 224/45 S |

*Primary Examiner*—Trygve M. Blix
*Assistant Examiner*—Kenneth W. Noland
*Attorney, Agent, or Firm*—Burd, Braddock & Bartz

[57] ABSTRACT

A ski boot carrier which is also adapted to the carrying of skis. The carrier comprises a base runner adapted for gliding movement over ice or snow on the upper surface of which is mounted a boot bag or similar carrying case. A flexible strap or band is secured to the boot carrying case. This strap or band functions as a handle for the carrying case. It also functions as a means for securing skis which may be carried in back-to-back relation mounted on the top of the carrying case. In this manner the skis are used as a handle to guide the carrier as it is pulled over snow or ice.

5 Claims, 5 Drawing Figures

FIG. 2

SKI BOOT CARRIER

BACKGROUND OF THE INVENTION

1. Field of the Invention

This invention is directed to a versatile ski boot carrier which is also adapted to carry skis as well as ski boots and other equipment.

Skiers are frequently required to carry a quantity of equipment a considerable distance, as from parking lot to lodge, and the like. Skis are bulky, heavy and expensive and for maximum life require treatment with care. Skis are normally quite long and difficult to carry. The present invention is directed to a carrier for alleviating these problems.

2. The Prior Art

A large number of ski boot carriers are available. For the most part they include a frame or panel having a handle at one end and to which a pair of boots may be secured in sole-to-sole relation. Skis for the most part are simply strapped together and carried as a unit, generally along with the ski poles. Penniman U.S. Pat. No. 3,721,373 is representative of the conventional type of boot carrier which is available. Pfleider U.S. Pat. No. 3,272,413 is similar except that the Pfleider carrier includes a rack for also carrying skis. These patents are more representative of the problem than of any solution to it.

Wilkins U.S. Pat. No. 3,917,137 discloses a combination apparatus for carrying skis, boots and poles in a single unit. However, this device is cumbersome, heavy when loaded, and awkward to maneuver.

Wakabayashi U.S. Pat. No. 3,779,568 shows a carrier for skis only in which the heel ends of the skis are clamped onto a carrier which in one mode rolls on wheels and in another mode functions as a runner for gliding movement over snow.

In a co-pending application, Ser. No. 802,621, the present applicant discloses a carrier which comprises a base runner on the upper surface of which are mounted two parallel spaced apart support means which in turn carry a pair of parallel spaced apart side-by-side boot clamping plates. A handle is secured to the forward ends of the clamping plates. Ski boots are clamped onto the carrier. Skis may be carried by placing them back-to-back between the boots with the toe ends of the skis adjacent the heels of the boots.

SUMMARY OF THE INVENTION

The present invention is directed to a ski boot carrier which may additionally function as a ski carrier and comprises a base runner to which is secured a lightweight flexible-walled ski boot carrying case. The carrying case has an opening through which ski boots may be inserted for carrying and removed when needed. The opening has a closure. A flexible band is secured to the top of the carrying case. The band, in the form of a loop, functions as a handle for carrying the case when carrying ski boots only. The band is provided with fastening means whereby the loop may be opened, wrapped around a pair of skis in sole-to-sole relation, and refastened. In this manner, the skis may be carried along with the boots and function as a handle for pulling the carrying case.

BRIEF DESCRIPTION OF THE DRAWINGS

The invention is illustrated in the accompanying drawings in which corresponding parts are identified by the same numerals and in which:

FIG. 1 is a side elevation of the carrier with both boots and skis in place;

FIG. 2 is a top plan view of the carrier on the line 2—2 of FIG. 1;

FIG. 3 is a section on the line 3—3 of FIG. 1 and in the direction of the arrows;

DESCRIPTION OF THE PREFERRED EMBODIMENT

Figures 4, 5, 6, 7, 8:
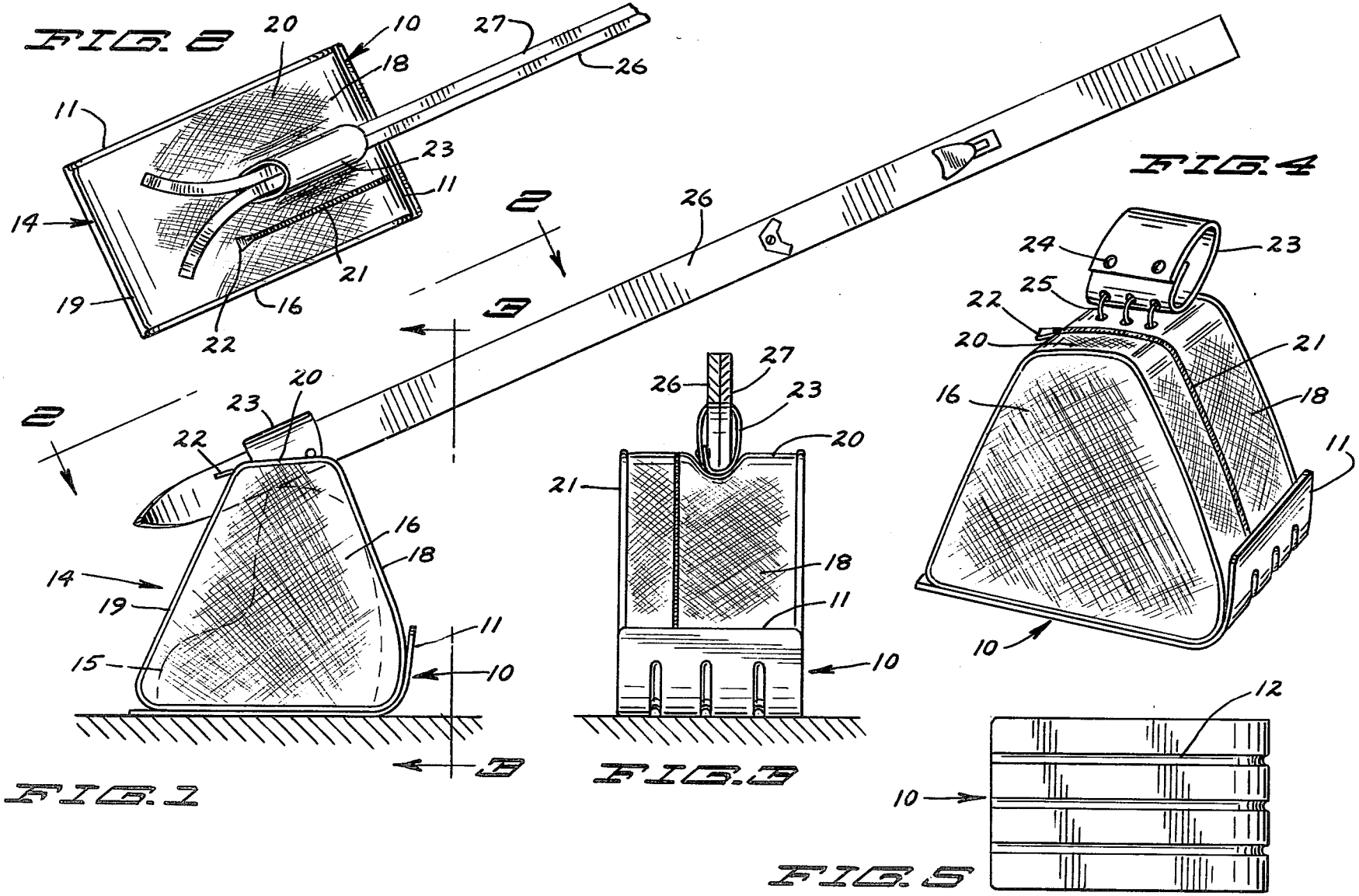
FIG. 4 is a perspective view of the boot carrier without skis.
FIG. 5 is a bottom plan view.

Referring now to the drawings, the ski boot carrier of the present invention comprises a base runner or sled, indicated generally at 10. Runner 10 preferably has an upwardly turned forward nose 11 to facilitate gliding passage through deep snow. The bottom surface of the runner is desirably provided with grooves 12, as shown, or ribs to facilitate gliding movement of the runner over ice or snow. The runner may be formed, for example, from wood, metal, etc. Preferably, however, to minimize weight, the runner is formed from synthetic resinous plastic material, such as fiber glass reinforced plastic formed into appropriate shape, polyethylene, or the like.

The flat body of runner 10 is generally rectangular and of a length and width to define an area somewhat larger than that required by a pair of ski boots resting in side-by-side relation. A boot carrying case, indicated generally at 14, of a size adapted to contain a pair of ski boots in side-by-side relation, is mounted on the flat rectangular body of the runner. Carrying case 14 may be secured to the base as by means of rivets, adhesives, or equivalent fastening means. Carrying case 14 is preferably contoured to conform somewhat to the side elevational profile of the boot to be contained therein, indicated in broken lines at 15 in FIG. 1.

Carrying case 14 is made of flexible material, desirably fabric such as canvas, heavy duty denim, or the like. It has a pair of generally vertical spaced apart side walls 16 and 17 to which are secured a bottom wall which is in face-to-face abutment with the runner 10, and front wall 18, rear wall 19, and top wall 20. The bottom, front, rear and top walls may be formed as separate panels or from a single length of fabric, as desired. An opening in the form of a longitudinal slit 21 is provided into the carrying case for access to insert or remove ski boots. As shown, the opening 21 is in front wall 18 and top wall 20 spaced between the opposite side walls. It could just as well be in the rear wall and top wall or at the seam of one of the side walls with the adjacent walls, or the like. As shown, opening 21 is closed with a slide fastener or zipper 22, but snap fasteners or other equivalent fastening means could also be used.

A relatively wide strap or band 23 is secured to the top wall 20 of the carrying case. Band 23 is in the form of a loop. The ends of the band are detachably secured by means of snap fasteners 24, or equivalent fastening means which permit the band loop to be opened. As shown, the band 23 is positioned so that the axis of the loop which it forms extends longitudinally. Although shown as secured by means of thongs 25, band 23 may also be secured by means of rivets or equivalent fastening means.

The band 23 is of such length that when it is closed and fastened, the resulting loop may extend around a pair of skis 26 and 27 placed together in sole-to-sole relation, as shown. As seen in FIG. 3, the weight of the skis causes the top wall of the carrying case to be indented so that the edge of the skis lie in a crevice between the tops of the boots. When a pulling force is exerted on the skis, the outwardly turned toes of the skis keep them in place in the band loop and exert force to pull the assembly. Thus, the skis themselves serve as a convenient handle for pulling the ski and boot assembly on the runner for gliding movement over snow or ice, or the like. The length of band 23 is desirably such that the skis fit loosely enough within the closed loop to permit them to be rotated through 90°. Then, although somewhat more cumbersome, the entire assembly may be carried with the skis resting on one's shoulder in the conventional manner. For carrying the equipment through doors and the like, the entire assembly may be grasped by the handle formed by the band 23 with the skis extending vertically, or by grasping the mid-section of the skis.

When the carrier device is used to carry boots only, without skis, then the wrist or arm can be extended through the loop formed by band 23, leaving both hands free for carrying skis, poles, etc. In addition to the boots, gloves, scarves, etc. can also be readily transported in the carrying case.

It is apparent that many modifications and variations of this invention as hereinbefore set forth may be made without departing from the spirit and scope thereof. The specific embodiments described are given by way of example only and the invention is limited only by the terms of the appended claims.

The embodiments of the invention in which an exclusive property or privilege is claimed are defined as follows:

1. A ski boot carrier comprising:

(A) a base runner adapted for gliding movement over snow, the body of said runner being generally flat and rectangular and provided with an upwardly turned forward nose, (B) a lightweight flexible-walled ski boot carrying case mounted on said runner, (C) an opening in said carrying case for insertion and removal of ski boots, (D) closure means for said opening, (E) a wide flexible band secured to the top of said carrying case, (2) said flexible band defining a loop whose axis extends longitudinally, and (2) the diameter of said loop being sufficient to receive and retain a pair of skis therein, and (F) fastening means for detachably securing the ends of said band together.

2. A ski boot carrier according to claim 1 wherein the bottom of said runner is provided with longitudinal grooves.

3. A ski boot carrier according to claim 1 wherein:

(A) said carrying case has a pair of generally vertical spaced apart side walls, a bottom wall, upwardly and inwardly extending end walls and a top wall, (B) said opening is a longitudinally extending slit in at least one of said end walls and top wall.

4. A ski boot carrier according to claim 3 wherein said closure means is a slide fastener.

5. A ski boot carrier according to claim 1 wherein the fastening means for detachably securing the ends of said band together is a snap fastener.

* * * * *

UNITED STATES PATENT AND TRADEMARK OFFICE

CERTIFICATE OF CORRECTION

PATENT NO. : 4,152,002

DATED : May 1, 1979

INVENTOR(S) : David V. Olson

It is certified that error appears in the above-identified patent and that said Letters Patent are hereby corrected as shown below:

Column 4, line 16, "(2)" should be --(1)--.

Signed and Sealed this

*Thirty-first* Day of *July 1979*

[SEAL]

*Attest:*

*Attesting Officer*

LUTRELLE F. PARKER

*Acting Commissioner of Patents and Trademarks*